US007750885B2

(12) United States Patent
Park et al.

(10) Patent No.: US 7,750,885 B2
(45) Date of Patent: Jul. 6, 2010

(54) LIQUID CRYSTAL DISPLAY DEVICE AND DRIVING METHOD

(75) Inventors: Kwon Shik Park, Seoul (KR); Soo Young Yoon, Goyung-si (KR); Tae Woong Moon, Seongnam-si (KR)

(73) Assignee: LG. Display Co., Ltd., Seoul (KR)

( * ) Notice: Subject to any disclaimer, the term of this patent is extended or adjusted under 35 U.S.C. 154(b) by 866 days.

(21) Appl. No.: 11/644,483

(22) Filed: Dec. 21, 2006

(65) Prior Publication Data

US 2007/0290981 A1 Dec. 20, 2007

(30) Foreign Application Priority Data

Jun. 19, 2006 (KR) ..... 10-2006-0054825

(51) Int. Cl.
*G09G 3/36* (2006.01)

(52) U.S. Cl. ..... 345/100; 345/87

(58) Field of Classification Search ..... 345/87–102, 345/204

See application file for complete search history.

(56) References Cited

U.S. PATENT DOCUMENTS 4,653,862 A 3/1987 Morozumi
5,253,091 A * 10/1993 Kimura et al. ..... 345/94
5,379,050 A * 1/1995 Annis et al. ..... 345/94
5,648,793 A * 7/1997 Chen ..... 345/96
5,790,092 A * 8/1998 Moriyama ..... 345/96
5,892,493 A * 4/1999 Enami et al. ..... 345/94
6,020,870 A * 2/2000 Takahashi et al. ..... 345/92
6,219,019 B1 * 4/2001 Hasegawa et al. ..... 345/96
6,243,062 B1 * 6/2001 den Boer et al. ..... 345/91
6,266,039 B1 * 7/2001 Aoki ..... 345/94
6,327,008 B1 * 12/2001 Fujiyoshi ..... 349/106

(Continued)

FOREIGN PATENT DOCUMENTS

DE 33 138 04 A1 9/1984

(Continued)

OTHER PUBLICATIONS

Office Action issued in corresponding Japanese Patent Application No. 2006-2833966; issued Dec. 21, 2009.

(Continued)

*Primary Examiner*—Nitin Patel
(74) *Attorney, Agent, or Firm*—Brinks Hofer Gilson & Lione

(57) ABSTRACT

A liquid crystal display device and driving method is provided. The liquid crystal display device includes a first data line to which a data voltage is supplied and a second data line separated from the first data line with a pixel row therebetween and connected to the first data line in top and bottom ends. A first gate line crosses the first and second data lines. A second gate line crosses the first and second data lines. A first switch device is operable to supply the data voltage from the first data line to a pixel electrode of an odd-numbered pixel row in response to the first scan pulse. A second switch device is operable to supply the data voltage from the second data line to a pixel electrode of an even-numbered pixel row in response to the second scan pulse.

13 Claims, 7 Drawing Sheets

U.S. PATENT DOCUMENTS

| | | | | |
|---|---|---|---|---|
| 6,429,842 | B1 * | 8/2002 | Shin et al. | 345/92 |
| 6,512,505 | B1 * | 1/2003 | Uchino et al. | 345/96 |
| 6,583,777 | B2 | 6/2003 | Hebiguchi et al. | |
| 6,744,417 | B2 * | 6/2004 | Yamashita et al. | 345/92 |
| 2002/0047820 | A1 * | 4/2002 | Ha | 345/87 |
| 2005/0237280 | A1 | 10/2005 | Oh et al. | |

FOREIGN PATENT DOCUMENTS

| | | |
|---|---|---|
| JP | 59-009636 | 1/1984 |
| JP | 04-360534 | 12/1992 |
| JP | 11-344724 | 12/1999 |
| KR | 10-2002-0057541 | 11/2002 |

OTHER PUBLICATIONS

Office Action issued in corresponding Japanese Patent Application No. 2006-283396; issued Mar. 26, 2009.

Office Action issued in corresponding German Patent Application No. 10 2006 0057 583; issued Oct. 6, 2009.

* cited by examiner

LIQUID CRYSTAL DISPLAY DEVICE AND DRIVING METHOD

This application claims the benefit of the Korean Patent Application No. P06-0054825 filed on Jun. 19, 2006, which is hereby incorporated by reference.

BACKGROUND

1. Field

The present embodiments relate to a liquid crystal display device, and a driving method thereof.

2. Related Art

Flat panel display devices have been used as a visual information transmission medium. The cathode ray tube or Braun tubes, which were conventionally used as the visual transmission medium, are heavy and large in size. Generally, the flat panel display device is lighter and smaller in size than the conventional cathode ray tube.

For example, flat panel display devices include a liquid crystal display (LCD), a field emission display (FED), a plasma display panel (PDP) and an electro luminescence (EL). Most of these display devices have been put to practical use and used on the market.

The liquid crystal display device has rapidly replaced with the cathode ray tube in many application fields. As electronic products are being produced that are lighter, thinner, shorter and smaller the demand for a display device with these characteristics has also increased. Thus, the liquid crystal display device has become popular because of the smaller and lighter design and the improved mass-productivity of the liquid crystal display device.

An active matrix type liquid crystal display device drives a liquid crystal cell by use of a thin film transistor (hereinafter, referred to as 'TFT'). An active matrix type liquid crystal display device has excellent picture quality and the power consumption is low. Because of the popularity of the liquid crystal display device a large amount of development has went into the product. The liquid crystal display device has high resolution is capable of being mass produced.

FIGS. 1 and 2 represent an active matrix type liquid crystal display device and a drive signal thereof according to the related art.

Referring to FIGS. 1 and 2, the active matrix type liquid crystal display device includes a liquid crystal display panel 13 where m×n number of liquid crystal cells Clc are arranged in a matrix type. M number of data lines D1 to Dm cross n number of gate lines G1 to Gn. A TFT is formed at the crossing part thereof. A data drive circuit 11 supplies data to the data lines D1 to Dm of the liquid crystal display panel 13. A gate drive circuit 12 supplies a scan pulse to the gate lines G1 to Gn.

The liquid crystal display panel 13 contains liquid crystal molecules between two glass substrates. The data lines D1 to Dm and the gate lines G1 to Gn formed on a lower glass substrate of the liquid crystal display panel 13 cross each other perpendicularly. The TFT formed at the crossing part of the data line D1 to Dm and the gate line G1 to Gn supplies a data voltage, which is supplied through the data line D1 to Dn, to the liquid crystal cell Clc in response to the scan pulse from the gate line G1 to Gn. A source electrode of the TFT is connected to a pixel electrode of the liquid crystal cell Clc. A black matrix, a color filter and a common electrode (not shown) are formed on an upper glass substrate of the liquid crystal display panel 13.

A polarizer where the optical axes are at right angles to each other is stuck onto the upper glass substrate and the lower glass substrate of the liquid crystal display panel 13. An alignment film for setting a pre-tilt angle of liquid crystal is formed on the inner surface being in contact with the liquid crystal.

A storage capacitor Cst is formed in each of the liquid crystal cells Clc of the liquid crystal display panel 13. The storage capacitor Cst is formed between a pre-stage gate line and a pixel electrode of the liquid crystal cell Clc or formed between a common electrode line (not shown) and the pixel electrode of the liquid crystal cell Clc, so as to fixedly maintain a voltage of the liquid crystal cell Clc.

The data drive circuit 11 is composed of a plurality of data drive IC's of which each includes a shift register, a latch, a digital-analog converter and an output buffer. The data drive circuit 11 latches the digital video data and converts the digital video data into an analog gamma compensation voltage to supply to the data lines D1 to Dm.

The gate drive circuit 12 is composed of a plurality of gate drive IC's of which each includes a shift register that sequentially shifts a start pulse for each one horizontal period to generate a scan pulse. A level shifter converts an output signal from the shift register into a signal of a suitable swing width for driving the liquid crystal cell Clc. An output buffer connected between the level shifter and the gate line G1 to Gn. The gate drive circuit 12 sequentially supplies the scan pulse to the gate lines G1 to Gn to select a horizontal line of the liquid crystal display panel 13 to which the data are to be supplied.

In FIG. 2, 'Vd' is a data voltage that is outputted by the data drive circuit 11 to be supplied to the data lines D1 to Dm, and 'Vlc' is a data voltage that is charged or discharged in the liquid crystal cell Clc. 'Scp' is a scan pulse that is generated for one horizontal period. 'Vcom' is a common voltage supplied to the common electrode of the liquid crystal cells Clc.

The liquid crystal display device has a high cost because a lot of data lines D1 to Dm are formed in the liquid crystal display panel 13 and because of the drive IC's of the data drive circuit 11 that supply the data voltage to the data lines D1 to Dm. The cost increases as the resolution gets higher or the liquid crystal display panel 13 is made larger.

In order to solve the problem caused by the increase of the data lines and the data drive IC's, two liquid crystal cell rows are driven with one data line so as to develop the technique of reducing the number of the data lines and the number of the drive IC's, as shown in FIG. 3. The liquid crystal display device of FIG. 3 connects the TFT for driving different liquid crystal cells from each other to the left and the right of the data lines D1, D2, D3 in a pixel array. The data lines D1, D2, D3 time-dividedly drives two liquid crystal cells disposed on the left and the right thereof by sequentially applying the scan pulse synchronized with the data to the two gate lines for each ½ horizontal period, thereby reducing the number of the data lines.

The liquid crystal display device as in FIG. 3 can reduce the number of data lines, but the TFT's connected to the left and the right of the data line increases the load of the data line.

Accordingly, a liquid crystal display device that reduces the number of data drive IC's and the load of a data line is desired.

SUMMARY

In one embodiment, a liquid crystal display device includes a first data line to which a data voltage is supplied. A second data line is separated from the first data line with a pixel row therebetween and connected to the first data line in top and bottom ends. A first gate line crosses the first and second data lines and to which a first scan pulse is supplied. A second gate line crosses the first and second data lines and to which a second scan pulse is supplied. A first switch device supplies the data voltage from the first data line to a pixel electrode of an odd-numbered pixel row in response to the first scan pulse. A second switch device supplies the data voltage from the second data line to a pixel electrode of an even-numbered pixel row in response to the second scan pulse.

In the liquid crystal display device, the first gate line G1, G3, . . . , Gn−1 is overlapped with the pixel electrode of the even-numbered pixel row and connected to a control terminal of the first switch device. The second gate line is overlapped with the pixel electrode of the odd-numbered pixel row and connected to a control terminal of the second switch device.

In the liquid crystal display device, the gate lines are patterned in a zigzag shape.

The liquid crystal display device further includes a data drive circuit that generates the data voltage through an output channel. A gate drive circuit sequentially generates the scan pulses.

In the liquid crystal display device, the data voltage is supplied to the data lines for approximately a ½ horizontal period. The scan pulses are synchronized with the data voltage and kept to be a high potential voltage for the approximately ½ horizontal period.

In the liquid crystal display device, a low potential voltage of the scan pulse is the same as a common voltage that is applied to a common electrode that faces the pixel electrode with a liquid crystal layer therebetween.

In another embodiment, a liquid crystal display device includes a plurality of closed-loop type data lines that are electrically connected and to which a data voltage is commonly supplied. A plurality of zigzag type gate lines cross the data lines and to which a scan pulse supplied. An odd-numbered pixel row is disposed in the data lines. An even-numbered pixel row is disposed between the data lines. A plurality of switch devices are disposed at the crossing parts of the data lines and the gate lines supply the data voltage from the data lines to pixels of the pixel rows in response to the scan pulse. A plurality of storage capacitors for keeping a voltage of each of the pixels of the pixel row, and the storage capacitor included in the odd-numbered pixel row is formed by a pixel electrode of the odd-numbered pixel row and an even-numbered gate line which overlap each other with a dielectric layer therebetween. The storage capacitor included in the even-numbered pixel row is formed by a pixel electrode of the even-numbered pixel row and an odd-numbered gate line which overlap each other with the dielectric layer therebetween.

In one embodiment, a driving method of a liquid crystal display device includes supplying a data voltage to first and second data lines which are connected to each other at top and bottom ends; sequentially supplying scan pulses to first and second gate lines which cross the first and second data lines; and supplying the data voltage from the first data line to a pixel electrode of an odd-numbered pixel row and supplying the data voltage from the second data line to a pixel electrode of an even-numbered pixel row in response to each scan pulse.

DETAILED DESCRIPTION

Figure 1:
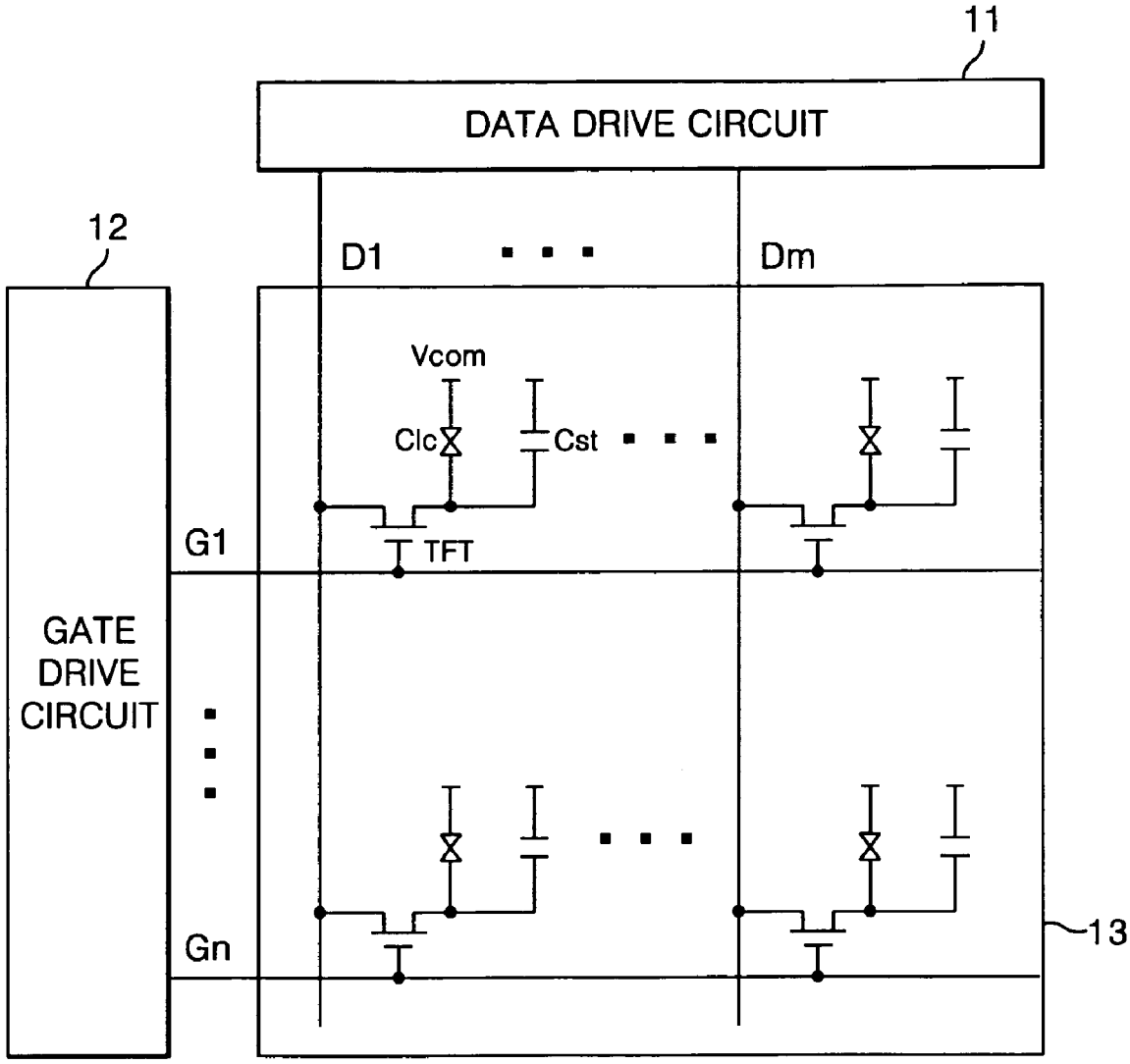
FIG. 1 RELATED ART
FIG. 1 is a diagram representing a liquid crystal display device according to the related art.
Figure 2:
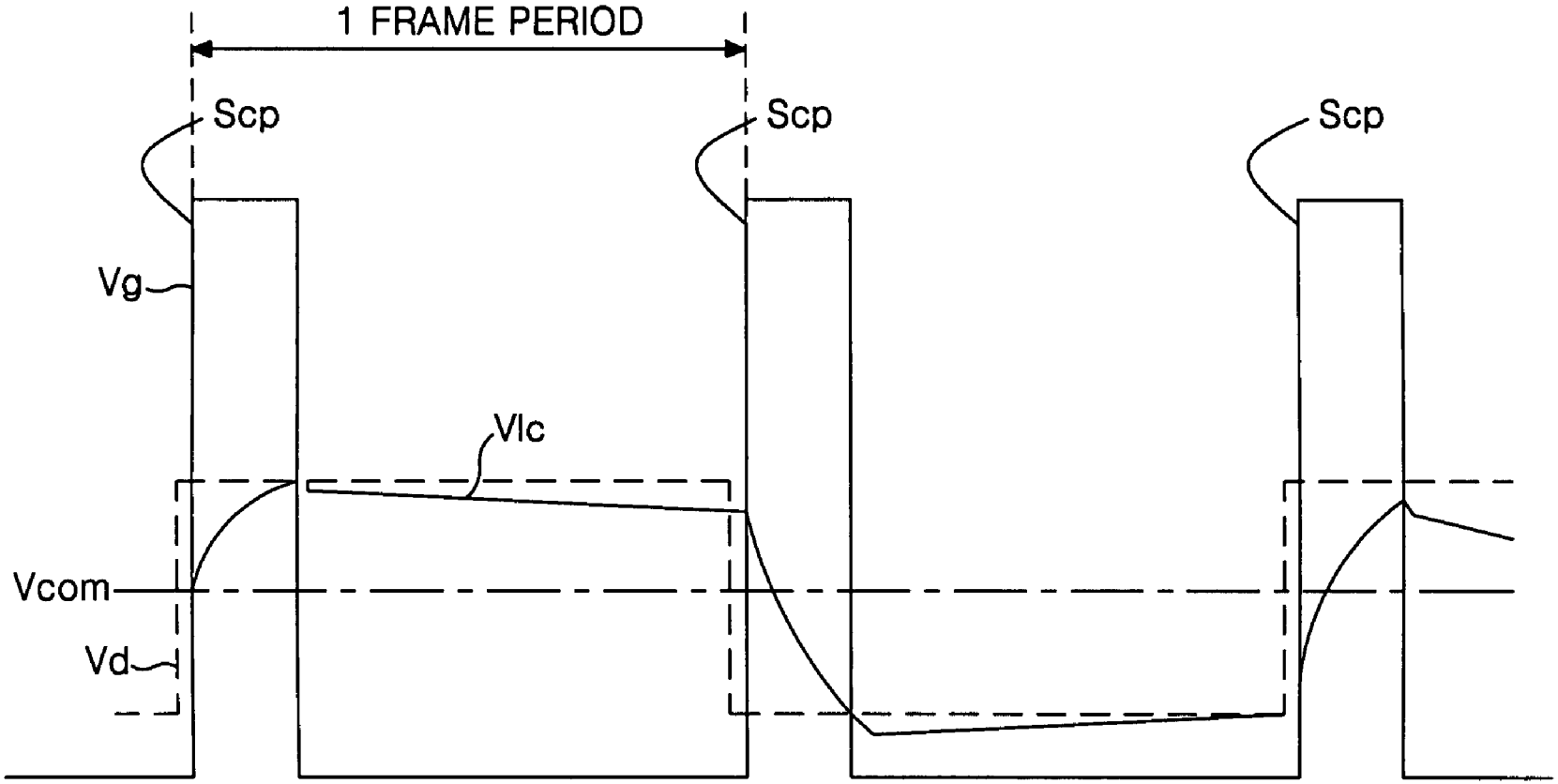
FIG. 2 RELATED ART
FIG. 2 is a waveform diagram showing a drive signal supplied to liquid crystal cells and a data voltage supplied to the liquid crystal cell in a liquid crystal display panel shown in FIG. 1.
Figure 3:
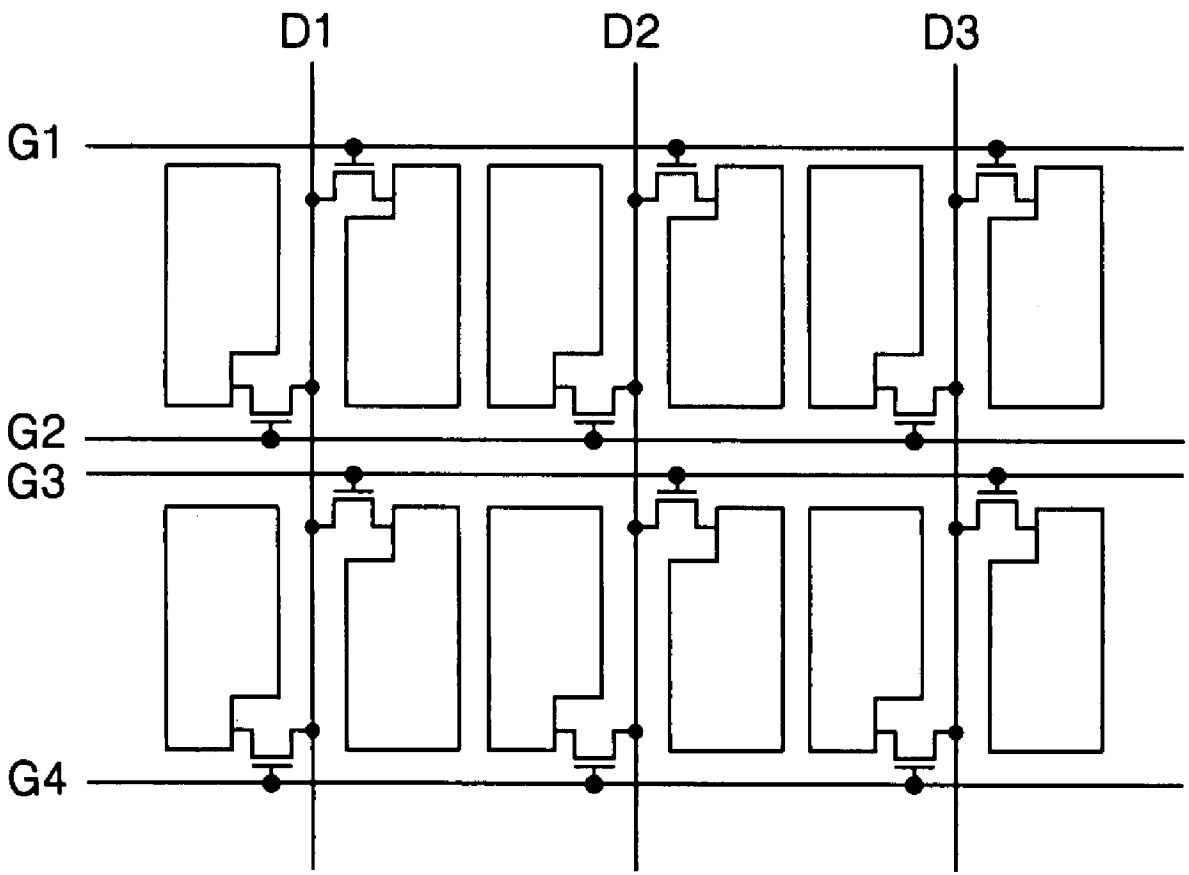
FIG. 3 RELATED ART
FIG. 3 is a diagram representing signal lines of the related art for reducing the number of data lines.
Figure 4:
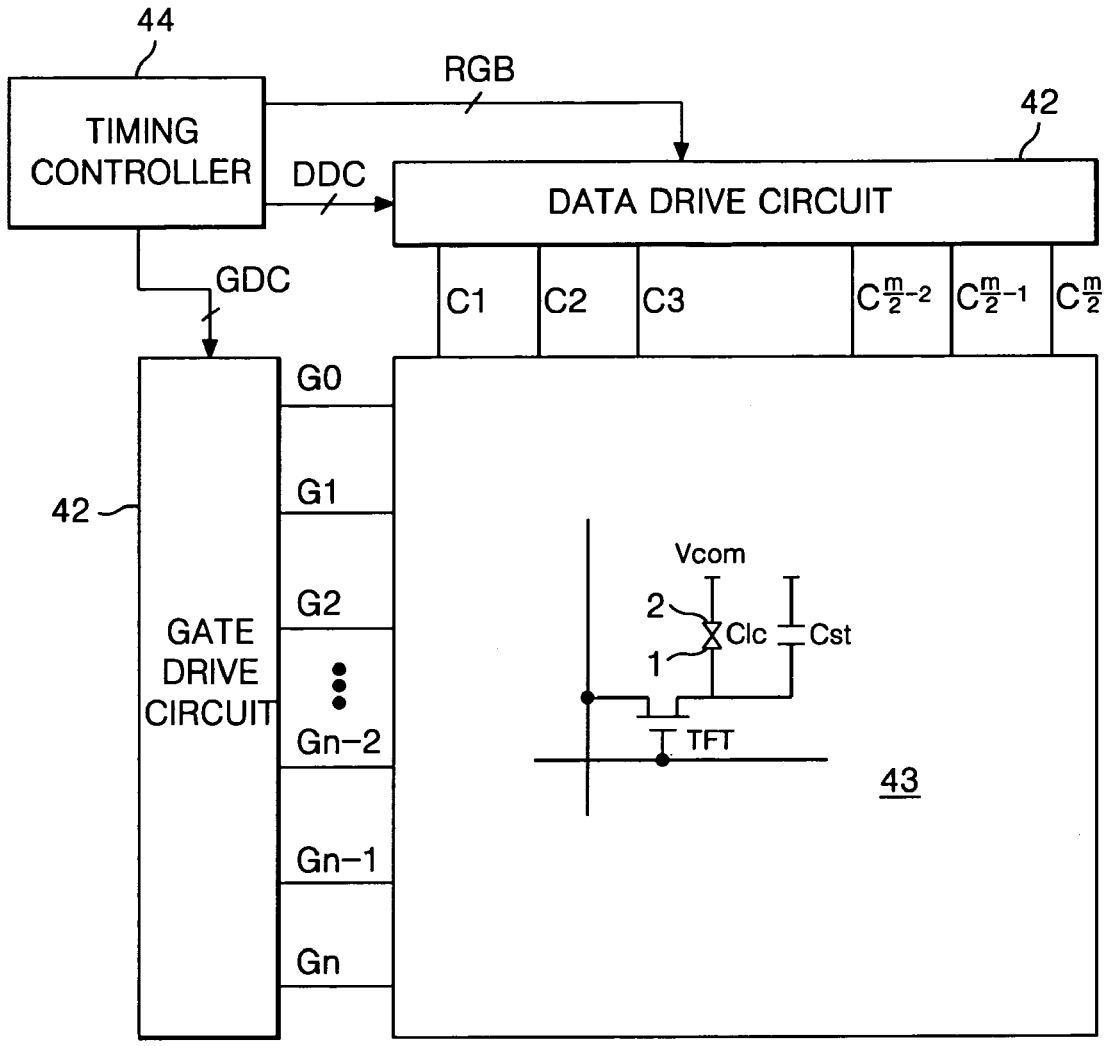
FIG. 4 is a diagram representing a liquid crystal display device according to one embodiment.
Figure 5:
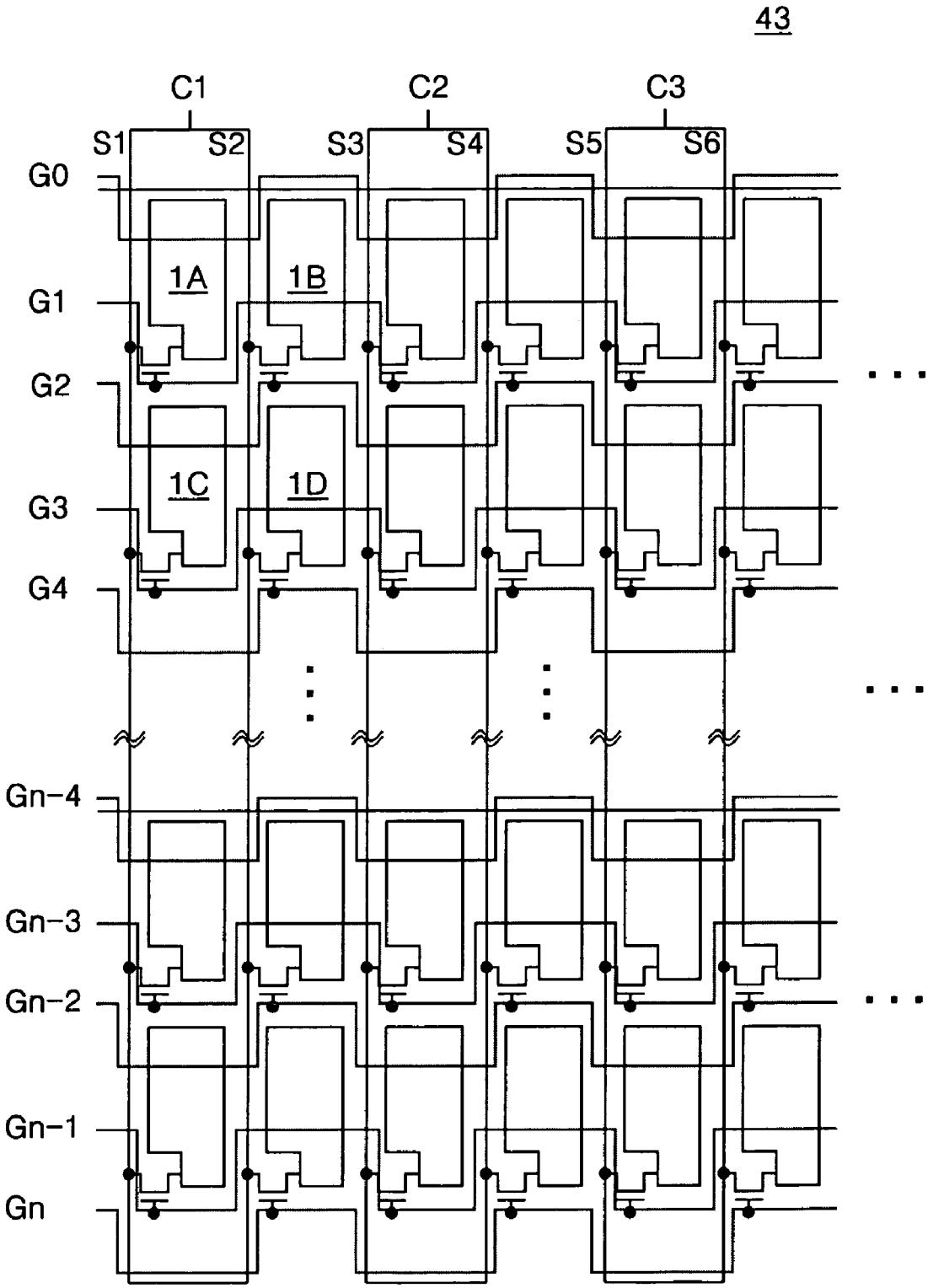
FIG. 5 is a diagram representing signal lines of a liquid crystal display panel shown in FIG. 4.

FIGS. 4 and 5 represent a liquid crystal display device. In one embodiment, the liquid crystal display device includes a liquid crystal display panel 43 where m×n number of liquid crystal cells Clc are arranged in a matrix type. A data drive circuit 41 outputs data through m/2 number of data output channels C1 to Cm/2. A gate drive circuit 42 supplies a scan pulse to gate lines G0 to Gn. A timing controller 44 controls the data drive circuit 41 and the gate drive circuit 42.

The liquid crystal display panel 43 injects liquid crystal molecules between two glass substrates. M number of data lines S1 to Sm/2 and n number of gate lines G0 to Gn, which are formed on a lower glass substrate of the liquid crystal display panel, cross each other.

Odd-numbered data lines S1, S3, . . . , Sn−1 and even numbered data lines S1 to Sm which are adjacent to each other in the liquid crystal display panel 43 are electrically connected in each of the upper and lower ends to form a closed-loop of a shape which encompasses one pixel row.

The upper end of the odd-numbered data lines S1, S3, . . . Sn−1 and the even numbered data lines S1 to Sm which form the closed-loop is electrically connected to an output channel C1 to Cm/2 of the data drive circuit. One data line closed-loop is connected to one data output channel.

The gate lines G0 to Gn are patterned in a zigzag shape. The odd-numbered gate lines G1, G3, . . . , Gn−1 overlap the pixel electrodes 1B, 1D disposed in an even-numbered pixel row and are connected to gate electrodes of the TFT's disposed in the odd-numbered pixel row. The even-numbered gate lines G0, G2, G4, . . . , Gn overlap the pixel electrodes 1A, 1C disposed in an odd-numbered pixel row and are connected to gate electrodes of the TFT's disposed in the even-numbered pixel row.

The TFT's are connected to the crossing part of the data lines S1 to Sm and the gate lines G0 to Gn. The TFT's are disposed on the left side of the data lines S1 to Sm. The TFT's supply the data voltage from the data line S1 to Sm to the pixel electrode 1 in response to the scan signal from the gate drive circuit 42. A gate electrode of the TFT is connected to the gate line G0 to Gn and a drain electrode is connected to the data line S1 to Sm. A source electrode of the TFT is connected to the pixel electrode 1 of the liquid crystal cell Clc. A common voltage Vcom is supplied to a common electrode 2 that faces the pixel electrode 1.

A storage capacitor Cst is formed in each liquid crystal cell of the liquid crystal display panel 43. The storage capacitor Cst is formed by the pixel electrode and the gate line G0 to Gn that overlap each other with a dielectric therebetween. The storage capacitor Cst maintains a voltage of the liquid crystal cell Clc. In the pixels disposed in the first line of the utmost top end, no scan pulse is supplied to the storage capacitor Cst that is formed between the pixel electrode of the first line and the gate line G0 of the utmost top end to which the common voltage Vcom is supplied. In the pixels arranged in the same row, the storage capacitor Cst of the odd-numbered pixel is formed by the overlapping of the pixel electrode of the odd-numbered pixel and $(n-1)^{th}$ (where n is a positive integer of not less than 0) gate line with a dielectric layer therebetween. The storage capacitor Cst of the even-numbered pixel is formed by the overlapping of the pixel electrode of the even-numbered pixel and $n^{th}$ gate line with a dielectric layer therebetween. For example, the odd-numbered pixels and the even-numbered pixels arranged in the same row are overlapped with the gate lines which are different from each other.

A black matrix, a color filter and a common electrode (not shown) are formed on the upper glass substrate of the liquid crystal display panel 43. Alternatively, the common electrode is formed on the upper glass substrate in a vertical electric field drive method such as a TN (twisted nematic) mode and a VA (vertical alignment) mode, and is formed on the lower glass substrate together with the pixel electrode 1 in a horizontal electric field drive method such as an IPS (in plane switching) mode and a FFS (fringe field switching) mode.

A polarizer where the optical axes are at right angles to each other is stuck onto the upper glass substrate and the lower glass substrate of the liquid crystal display panel 43. An alignment film that sets a pre-tilt angle of liquid crystal is formed on the inner surface being in contact with the liquid crystal.

The data drive circuit 41 is composed of a plurality of data drive IC's of which each includes a shift register, a latch, a digital-analog converter and an output buffer. The data drive circuit 41 latches the digital video data under control of the timing controller 44 and converts the digital video data into a positive/negative analog gamma compensation voltage to be outputted through the data output channels C1 to Cm/2 as the positive/negative data voltage. The data output channels C1 to Cm/2 are connected to the data lines S1 to Sm in a ratio of 1:2. For example, one data output channel is connected to two data lines which are connected to the closed-loop. The data voltages are synchronized with the scan signals to be outputted for each unit of approximately ½ horizontal period to be supplied to the two data lines D1 to Dm that are connected to the closed-loop.

The gate drive circuit 42 is composed of a plurality of gate drive IC's that includes a shift register. A level shifter converts an output signal from the shift register into a signal of a suitable swing width that drives the liquid crystal cell. An output buffer is connected between the level shifter and the gate line G1 to Gn. The gate drive circuit 42 sequentially outputs the scan pulse for approximately ½ horizontal period.

The timing controller 44 receives a vertical/horizontal synchronization signal and a clock signal and generates a gate control signal GDC that controls the gate drive circuit 42 and a data control signal DDC that controls the data drive circuit 42. The gate control signal GCD includes, for example, a gate start pulse GSP, a gate shift clock signal GSC that drives the shift register, a gate output signal GOE. For example, the gate start pulse GSP and the gate shift clock signal GSP are generated to have a pulse width of an approximately ½ horizontal period so that a pulse width of the scan pulse is an approximately ½ horizontal period. The data control signal DDC includes, for example, a source start pulse GSP, a source shift clock SSC, a source output signal SOE, a polarity signal POL. For example, the source output signal SOE and the polarity signal POL are generated for each ½ horizontal period so that the positive/negative data voltage are outputted for an approximately ½ horizontal period.

Together with a timing control of the drive circuits 41 and 42, the timing controller 44 also acts to sample and re-align the digital video data RGB to supply to the data drive circuit 41.

In one embodiment, the liquid crystal display device has a low load, for example a low electrical resistance, because the number of TFT's connected to the data lines S1 to Sn is low and the width of the data line is broadened by a closed-loop structure. Accordingly, the liquid crystal display device of the present invention can delay the voltage drop and delay of the data voltage by reducing the load of the data lines, for example, RC load.

Figure 6:
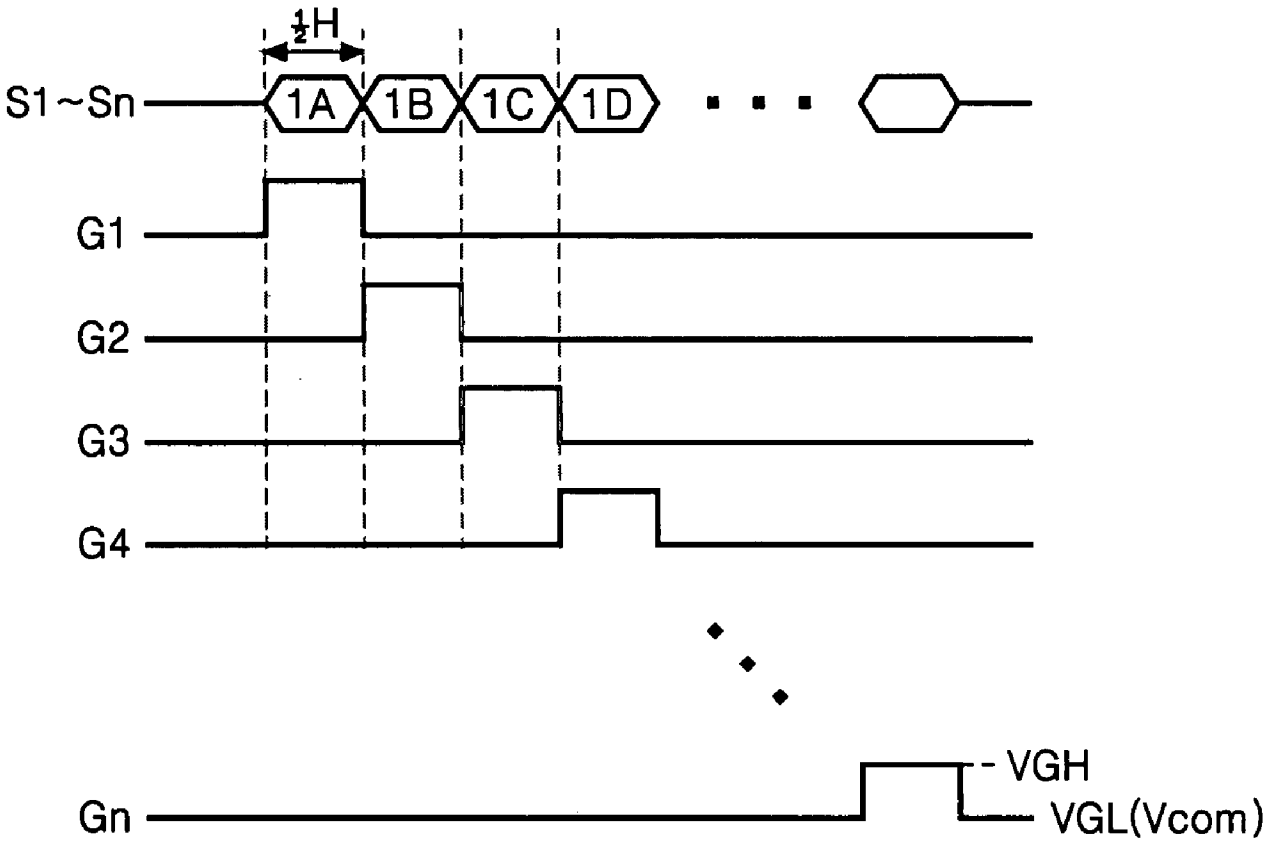
FIG. 6 is a waveform diagram showing drive signals of the liquid crystal display panel shown in FIG. 4.

FIG. 6 represents a drive waveform of a liquid crystal display device according to one embodiment.

Referring to FIG. 6, the data drive circuit 41 generates a data voltage through the output channels C1 to Cm/2 for each approximately ½ horizontal period. The gate drive circuit 42 generates a scan pulse synchronized with the data voltage for each approximately ½ horizontal period.

During the first scan period of the approximately ½ horizontal period when the first scan pulse is supplied to the first gate line G1, the data voltage of the first line is supplied to the data lines S1 to Sn. In one embodiment, at this moment, only the TFT's disposed in the odd-numbered pixel row of the first line are turned on by the first scan pulse, thus the data voltage is charged in the pixel electrodes 1A, 1C of the odd-numbered pixel row.

In one embodiment, during the second scan period of the approximately ½ horizontal period when the second scan pulse is supplied to the second gate line G1, the data voltage of the second line is supplied to the data lines S1 to Sn. At this moment, only the TFT's disposed in the even-numbered pixel row of the first line are turned on by the second scan pulse. Accordingly, the data voltage is charged in the pixel electrodes 1B, 1D of the even-numbered pixel row. In one embodiment, while the even-numbered pixel row of the first line is selected, the TFT disposed in the odd-numbered pixel row of the first line is turned off by a gate low voltage, for example, a common voltage Vcom. Accordingly, in one embodiment, while the even-numbered pixel row of the first line is selected, the liquid crystal cells Clc are disposed in the odd-numbered pixel row maintain the data voltage supplied for the first scan period by the storage capacitor Cst that is formed between the $0^{th}$ gate line G0 and the pixel electrode 1A. The $0^{th}$ gate line G0 is only overlapped with the pixel electrodes 1A of the odd-numbered pixel row in the utmost top row and is not connected to the TFT's. The storage capacitor Cst can also be formed even in the even-numbered pixels of the utmost top row by the $0^{th}$ gate line G0. Alternatively, the pixel electrode is formed by the overlapping of the first gate line G1 and the pixel electrode 1B in the even-numbered pixels in the utmost top row.

The scan pulse alternates between a gate high voltage VGH of not less than a threshold voltage of the TFT and a gate low voltage VGL of less than the threshold voltage of the TFT. In this embodiment, the gate low voltage VGL should be generated to be the same voltage as the common voltage Vcom supplied to the common electrode 2 so that the data voltage is fixedly kept in the liquid crystal cell Clc.

Figure 7:
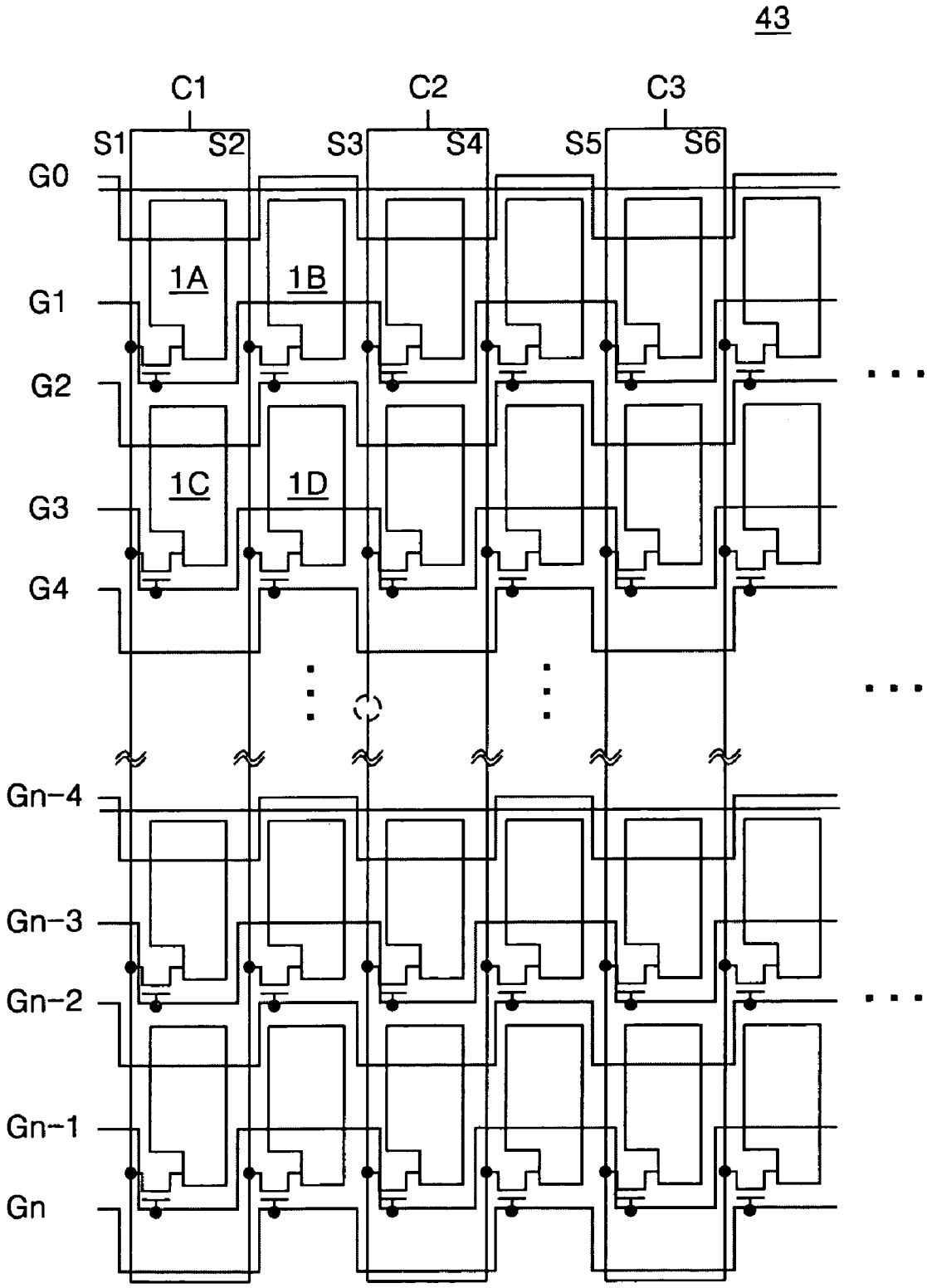
FIG. 7 is a diagram showing a state that a part of signal lines shown in FIG. 5.

In one embodiment, the data line S1 to Sm is opened because of the pattern defect generated in the fabrication process, as in FIG. 7, the data voltage can be transmitted in a normal manner because the data lines S1 to Sm form the closed-loop circuit. Accordingly, in one embodiment, the liquid crystal display panel can be driven in a normal manner without a repair process even though the data line is opened to be broken in the dotted-line circle part.

The foregoing embodiment has been explained centering on the fact that one output channel of the data drive circuit 41 is connected by two data lines, but one output channel of the data drive circuit 41 can be connected to not less than two data lines. For example, it is possible that the data voltage is time-divided for each ⅓ horizontal period and the three data voltages that are sequentially generated from one output channel of the data drive circuit 41 are supplied to the three data lines in a time division manner. In this embodiment, the channel number of the data drive circuit 41 is reduced to ⅓ in comparison with the related art.

In one embodiment, the liquid crystal display device and the driving method thereof connect the data lines, which are more than an integer multiple of the number of output channels, to the output channel of the data drive IC and forms the closed-loop by shorting the data lines in the upper and lower ends, thereby making it possible to reduce the load by lowering the electrical resistance of the data line. In one embodiment, the data voltage is supplied to all the pixel arrays in the normal manner even though a part of the data lines connected to the closed-loop is broken.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a first data line to which a data voltage is supplied;

a second data line separated from the first data line with a pixel row therebetween and connected to the first data line;

a first gate line that crosses the first and second data lines and to which a first scan pulse is supplied;

a second gate line that crosses the first and second data lines and to which a second scan pulse is supplied;

a first switch device that is operable to supply the data voltage from the first data line to a pixel electrode of an odd-numbered pixel row in response to the first scan pulse; and a second switch device that is operable to supply the data voltage from the second data line to a pixel electrode of an even-numbered pixel row in response to the second scan pulse.

2. The liquid crystal display device according to claim 1, wherein the first gate line overlaps the pixel electrode of the even-numbered pixel row and connected to a control terminal of the first switch device, and the second gate line overlaps the pixel electrode of the odd-numbered pixel row and connected to a control terminal of the second switch device.

3. The liquid crystal display device according to claim 1, wherein the gate lines are patterned in a zigzag shape.

4. The liquid crystal display device according to claim 1, further comprising:

a data drive circuit that generates the data voltage through an output channel; and a gate drive circuit that sequentially generates the scan pulses.

5. The liquid crystal display device according to claim 4, wherein the data voltage is supplied to the data lines for approximately ½ horizontal period, and the scan pulses are synchronized with the data voltage and kept to be a high potential voltage for the approximately ½ horizontal period.

6. The liquid crystal display device according to claim 5, wherein a low potential voltage of the scan pulse is the same as a common voltage that is applied to a common electrode that faces the pixel electrode with a liquid crystal layer therebetween.

7. A liquid crystal display device, comprising:

a plurality of closed-loop type data lines that are electrically connected and to which a data voltage is commonly supplied;

a plurality of zigzag type gate lines that cross the data lines and to which a scan pulse is supplied;

an odd-numbered pixel row disposed in the data lines;

an even-numbered pixel row disposed between the data lines;

a plurality of switch devices disposed at the crossing of the data lines and the gate lines that supply the data voltage from the data lines to pixels of the pixel rows in response to the scan pulse; and a plurality of storage capacitors that store a voltage of each of the pixels of the pixel row, wherein the storage capacitor included in the odd-numbered pixel row is formed by a pixel electrode of the odd-numbered pixel row and an even-numbered gate line that overlap each other with a dielectric layer therebetween, and the storage capacitor included in the even-numbered pixel row is formed by a pixel electrode of the even-numbered pixel row and an odd-numbered gate line that overlap each other with the dielectric layer therebetween.

8. The liquid crystal display device according to claim 7, wherein the data voltage is supplied to the data lines for approximately ½ horizontal period, and the scan pulse is synchronized with the data voltage and kept to be a high potential voltage for the approximately ½ horizontal period.

9. The liquid crystal display device according to claim 8, wherein a low potential voltage of the scan pulse is the same as a common voltage that is applied to a common electrode that faces the pixel electrode with a liquid crystal layer therebetween.

10. A driving method of a liquid crystal display device, comprising the steps of:

supplying a data voltage to first and second data lines, which are connected to each other;

sequentially supplying scan pulses to first and second gate lines, which cross the first and second data lines; and supplying the data voltage from the first data line to a pixel electrode of an odd-numbered pixel row and supplying the data voltage from the second data line to a pixel electrode of an even-numbered pixel row in response to each scan pulse.

11. The driving method according to claim 10, wherein the gate lines are patterned in a zigzag shape; and a storage capacitor included in the odd-numbered pixel row is formed by a pixel electrode of the odd-numbered pixel row and an even-numbered gate line, which overlap each other with a dielectric layer therebetween, and the storage capacitor included in the even-numbered pixel row is formed by a pixel electrode of the even-numbered pixel row and an odd-numbered gate line which overlap each other with the dielectric layer therebetween.

12. The driving method according to claim 10, wherein the data voltage is supplied to the data lines for approximately ½ horizontal period, and the scan pulses are synchronized with the data voltage and kept to be a high potential voltage for the approximately ½ horizontal period.

13. The driving method according to claim 12, wherein a low potential voltage of the scan pulse is the same as a common voltage applied to a common electrode that faces the pixel electrode with a liquid crystal layer therebetween.

* * * * *